US006057765A

United States Patent [19]

Jones et al.

[11] Patent Number: 6,057,765

[45] Date of Patent: May 2, 2000

[54] NON-LINEAR JUNCTION DETECTOR

[75] Inventors: Thomas H. Jones; Bruce R. Barsumian, both of Cookeville, Tenn.

[73] Assignee: Research Electronics International, Cookeville, Tenn.

[21] Appl. No.: 09/167,844

[22] Filed: Oct. 7, 1998

[51] Int. Cl.[7] ..... G08B 13/14

[52] U.S. Cl. ..... 340/572.2; 340/693.6; 340/691.1; 340/825.54; 342/44; 342/46; 455/115; 455/67.2; 455/166.1; 455/228

[58] Field of Search ..... 340/572.2, 693.6, 340/693.5, 691.1, 825.54; 342/46, 44; 455/115, 67.2, 166.1, 228; 367/128

[56] References Cited

U.S. PATENT DOCUMENTS

| | | | |
|---|---|---|---|
| 3,631,484 | 12/1971 | Augenblick | 342/46 |
| 3,745,569 | 7/1973 | Works et al. | 342/44 |
| 3,939,420 | 2/1976 | Risberg et al. | 455/115 |
| 4,063,229 | 12/1977 | Welsh et al. | 340/571 |
| 4,123,749 | 10/1978 | Hartmann et al. | 340/572.1 |
| 4,264,978 | 4/1981 | Whidden | 455/67.2 |
| 4,368,539 | 1/1983 | Whidden | 455/166.1 |
| 4,399,556 | 8/1983 | Whidden | 455/67.2 |
| 4,413,254 | 11/1983 | Pinneo et al. | 340/572.6 |
| 4,471,344 | 9/1984 | Williams | 340/572.2 |
| 4,700,179 | 10/1987 | Fancher | 340/572.2 |
| 4,805,231 | 2/1989 | Whidden | 455/228 |
| 5,030,940 | 7/1991 | Siikarla | 340/572.2 |
| 5,717,656 | 2/1998 | Dourbal | 367/128 |
| 5,777,561 | 7/1998 | Chieu et al. | 340/825.54 |

OTHER PUBLICATIONS

Audiotel Brochure, SuperBroom and Broom ECM (2 pp.) (undated).

Boomerang[4] Brochure, Information Security Associates, Inc., 1992.

Operating Instructions Boomerang™ Non–Linear Junction Detector NJD–4, Oct. 1, 1994, Inormation Security Associates, Inc., 13 pp.

"Hawk" Non–Linear Junction Detector Model 400/B Guidance Manual, 8 pp. (undated).

Locator Pro Non–Linear Junction Detector with Third Harmonic Guidance Manual, International Procurement Services Ltd. Locator Pro, Jul. 24, 1996, 9 pp., London.

Nonlinear Radio Locator NR 900 E (Russian language), 12 pp. (undated).

N.S. Vernigorov, Method of Detection of the Subjects by Nonlinear Radar (Russian language), 6 pp. (undated).

Russian language page containing at the top a 4–column table and at the bottom text and a drawing (undated).

*Primary Examiner*—Benjamin C. Lee
*Attorney, Agent, or Firm*—Luedeka, Neely & Graham, P.C.

[57] ABSTRACT

A non-linear junction detector designed for counter surveillance measures achieves superior performance by using a single circularly polarized antenna to transmit a signal and to receive harmonics of the transmitted signal that are re-radiated by a non-linear junction such as would be found in a eavesdropping device containing a semiconductor. The antenna is mounted on a telescoping antenna extension assembly. A single electrically conductive cable is contained inside the antenna and connects the antenna to the transceiver case which houses the non-linear junction detector electronics. A cable winder is built into the antenna and is employed to provide automatic dispensing and retraction of the cable when the antenna extension assembly is extended or retracted. A display is built into the antenna head assembly to provide signal strength indications and operational information concerning the functioning of the non-linear junction detector to the user of the device. The control signals and power for the display are multiplexed onto the single electrically conductive cable.

23 Claims, 11 Drawing Sheets

FIG. 4.a.
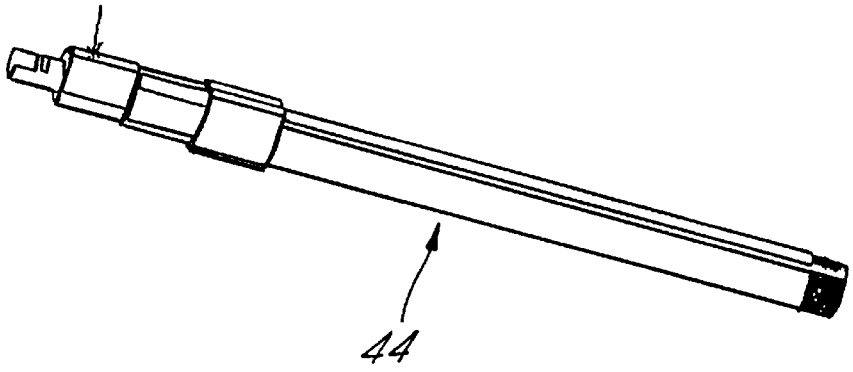
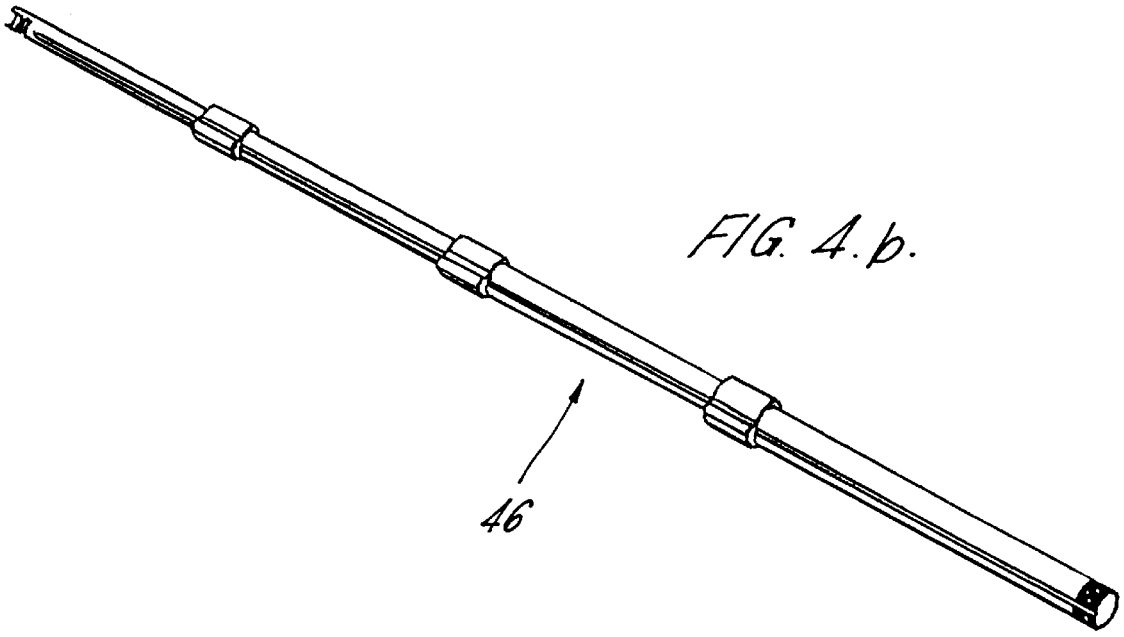
FIG. 4.b.

56

NON-LINEAR JUNCTION DETECTOR

FIELD OF THE INVENTION

The present invention is directed to an apparatus for detecting the presence of non-linear junctions such as are found in eavesdropping devices and other devices that contain semiconductors. More particularly, the present invention relates to a non-linear junction detector that uses a single circularly polarized antenna mounted on an extendable antenna assembly that is connected to a transceiver assembly by a single electrically conductive cable.

BACKGROUND OF THE INVENTION

A non-linear junction is a junction between different materials for which a change in the voltage applied across the junction does not produce a proportional change in the current flowing through the junction. These non-linear junctions are found in semiconductor components such as diodes, transistors and integrated circuits. However, non-linear junctions also occur naturally and can be detected in rock, building material crystals, and metal/oxide junctions. One common source of non-linear junctions is the large number of structural fasteners such as nails, screws, bolts and the like that are almost always found in buildings. These non-linear junctions distort electrical signals that pass through the junction. Subjecting such a non-linear junction to a strong high frequency radio signal causes an electric current to flow through the non-linear junction. The non-linearity in the junction causes a distortion of the originating radio signal thereby generating signals at harmonic frequencies of the incoming signal. At least a second harmonic signal at twice the transmitted frequency and a third harmonic signal at three times the transmitted frequency are typically re-radiated when a non-linear junction is subjected to a high frequency radio signal.

A non-linear junction detector is a device that is used in a fashion similar to a metal detector. However, while a metal detector is designed to detect metal, a non-linear junction detector is designed to detect semiconductor non-linear junctions in electronic devices such as diodes and transistors. A non-linear junction detector works on the principle that by radiating a non-linear junction with sufficiently powerful signals, detectable signals at integral multiples of the frequency of the signal originally radiated on the non-linear junction will be produced and re-radiated by the non-linear junction. Because they occur at harmonic frequencies of the original radiated signal, these re-radiated signals are known as harmonics or harmonic signals. By detecting the presence of these harmonics, the non-linear junction detector can detect the presence of a non-linear junction.

One application that has been devised for non-linear junction detectors is to affix a tag containing a non-linear junction to items in a store that are likely to be shoplifted. A non-linear junction detector is then placed at the exit of the store. When a customer purchases an item, the tag containing the non-linear junction is removed. If the non-linear junction tag is not removed before the item is taken from the store, an alarm will sound when the tag passes through the non-linear junction detector to inform the store's employees that an item is being stolen. Thus, non-linear junction detection technology has been adapted for shoplifting prevention.

Non-linear junction detectors have also been used to detect and locate covert surveillance devices that may be hidden in a room for the purpose of making audio or visual recordings of the activities occurring in the room. These covert surveillance devices contain electronic devices that have non-linear junctions. To locate the surveillance devices, the non-linear junction detector is waved in a sweeping pattern over all the areas in which a surveillance device may be hidden. When the device is waved above a non-linear junction, an alarm notifies the user that a non-linear junction has been detected. One major advantage to using a non-linear junction detector for counter surveillance measures is that it is possible to detect a hidden bugging device even if the device is not turned on and operating.

However, these non-linear junction detectors suffer from several drawbacks. For example, non-linear junction detectors typically utilize linearly polarized antennas. Using linearly polarized antennas forces the user to scan surfaces in both a horizontal and vertical motion to ensure that a surveillance device is not present with a polarized harmonic return that is perpendicular to the non-linear junction detector's receiver function. The additional time required to scan an area in both a horizontal and vertical fashion results in additional time and money being expended to search an area for surveillance devices.

Current models of non-linear junction detectors generally have a single antenna head that contains at least two antennas. One antenna is for transmitting the original signal and the other is for receiving a re-radiated harmonic of the transmitted signal. If the non-linear junction detector has the capability to receive both the second and third harmonics of the re-radiated signal, then three antennas are utilized, one antenna to receive the second harmonic, one to receive the third harmonic, and one to transmit the original frequency signal. Multiple cables are used to connect these multiple antennas to the transmitter and receivers of the non-linear junction detector. In addition, more cables are needed to support a display on the antenna head that informs the user when a non-linear junction has been detected. These additional cables tend to interfere with the use of the non-linear junction detector. Furthermore, multiple cables and antennas lead to increased cost and complexity in the non-linear junction detector.

Finally, prior art non-linear junction detectors tend to produce an excessive number of false alarms due to the presence of dissimilar metal junctions. This results in an increased amount of time and money needed to search a given area for surveillance devices. Furthermore, because dissimilar metal junctions may occur practically anywhere, the unknown type of non-linear junction may be inside of a wall or under a floor where it is very difficult to determine the type of non-linear junction present without causing damage to the surroundings. As used herein, "dissimilar metals" refers to corroded metal such as a rusty nail or any other material made up of two touching dissimilar metals, such as galvanized steel.

SUMMARY OF THE INVENTION

The present invention overcomes the deficiencies of the prior art by providing an apparatus for detecting the presence of covert surveillance devices containing non-linear semi-conductor junctions. The apparatus has a transmitter that produces a transmit signal having an amplitude. In accordance with one embodiment, a single broadband antenna transmits the transmit signal as electromagnetic waves that radiate outward from the antenna and receives the second and third harmonic signals of the transmitted signal that have been re-radiated by a non-linear junction. A receiver receives the second and third harmonic signals from the broadband antenna and produces conditioned harmonic signals. A display is located on the antenna to display an alpha-numeric message, a transmit power reading, a second harmonic power reading, and a third harmonic power reading. In this embodiment, a single electrically conductive cable electrically connects the transmitter and the receiver to the broadband antenna and provides power and control signals to the display. A diplexer electrically connects the receiver and the transmitter to the antenna and isolates the transmit signal from the receiver. The diplexer has a low pass filter that prevents any harmonics generated by the transmitter from interfering with the received harmonics and a high pass filter that prevents the transmitted signal from entering the receiver.

In accordance with a particular aspect of the present invention, a retractable antenna extension assembly supports the broadband antenna and houses the single electrically conductive cable that electrically connects the receiver and the transmitter to the broadband antenna. An antenna connection joint is attached to the retractable antenna extension assembly and the broadband antenna in a manner that provides two axis of rotation for the broadband antenna. A, keypad provides user control of the non-linear junction detector. A microprocessor control circuit receives signals from the keypad, sends signals to the display, determines the amplitudes of the second and third harmonics, produces encoded audio signals representing the amplitude of the second and third harmonics and produces demodulated versions of the received harmonic signals. A cable or cord winder automatically removes any slack produced in the electrically conductive cable when the retractable antenna extension assembly is retracted and provides additional electrically conductive cable when the retractable antenna extension assembly is extended. The retractable antenna extension assembly is mounted )n a transceiver case that contains the transmitter, receiver, microprocessor control circuit and audio circuitry. The transceiver case is rotatably connected to the retractable antenna extension assembly by a connection joint. A slip ring assembly electrically connects the conductive cable to the display electronics. The receiver demodulates the received signals from either the second or third harmonic. The method of demodulation may be either amplitude or frequency demodulation (AM or FM). The audio circuitry provides the demodulated audio signals to both a headphone jack and to an infrared transmitter to provide wireless audio to a pair of wireless infrared headphones. While it is preferred to use the antenna extension assembly with a single antenna, a single conducting cable, and infrared headphones, the antenna extension assembly could be used in other configurations.

The above described invention improves upon the prior art by providing a non-linear junction detector that transmits the transmit signal and receives the second and third harmonics re-radiated by a non-linear junction with a single antenna. The received and transmitted signals are contained on a single electrically conductive cable and are separated from one another by a diplexer. This single antenna design is less complex and costly than prior art antennas for non-linear junction detectors.

In addition, the retractable antenna extension assembly that houses the electrically conductive cable allows the non-linear junction detector to be configured to a length that is convenient to use. Any slack in the electrically conductive cable that results from retracting the antenna extension assembly is automatically removed by the cord winder and any additional cable required to extend the antenna extension assembly is automatically provided by the cord winder. Likewise, mounting the single antenna in a manner that provides two axis of rotation allows the antenna to be rotated with respect to the antenna extension assembly so that the antenna is approximately parallel to the surface being scanned. Rotatable connection joints between the antenna extension assembly and the transceiver case and the antenna allow the non-linear junction detector to be folded into a compact configuration for carrying or storing. Thus, the present invention is more convenient to use than prior art non-linear junction detection devices.

An especially preferred embodiment of the present invention for detecting the presence of non-linear junctions has a transmitter for producing a transmit signal. A circularly polarized antenna circularly polarizes and transmits the transmit signal and receives circularly polarized harmonic return signals re-radiated by a non-linear junction. A receiver receives the harmonic signals from the circularly polarized antenna and produces a demodulated signal. A retractable antenna extension assembly supports the circular polarization antenna and an electrically conductive cable that electrically connects the receiver and the transmitter to the circular polarization antenna. A microprocessor receives and analyzes the demodulated signals. A display under control of the microprocessor displays an alpha-numeric message, a transmit power reading, a second harmonic power reading, and a third harmonic power reading. A keypad provides user control of the non-linear junction detecting device.

Using a non-linear junction detector with a circularly polarized antenna allows non-linear junctions to be detected regardless of the angle at which the device is swept over the non-linear junction. Prior art devices typically utilize a linearly polarized antenna that might not detect a device with a polarized harmonic return that is perpendicular to the non-linear junction detector's receiver function. Thus, by using a circularly polarized antenna in the non-linear junction detector, the antenna will receive properly polarized returns without having to scan the target surfaces in multiple orientations. It should also be noted that, with a circularly polarized antenna, the transmitted and received signal's polarization is identical. They will all be either right hand or left hand circularly polarized. This provides an additional advantage because reflections of the transmitted waveform will return to the antenna with an opposite polarization, but harmonic returns will re-radiate at the same polarization as the transmit waveform. This has the effect of providing additional isolation from the transmitted signal's reflections. For example, if the transmit signal is right hand circularly polarized, the reflected waveform will be left hand circularly polarized and the received harmonics will be right hand circularly polarized. Thus, the antenna's circular polarization will provide more inherent isolation from the reflected transmit signal than found in prior art non-linear junction detectors.

BRIEF DESCRIPTION OF THE DRAWINGS

Further advantages of the invention will become apparent by reference to the detailed description of preferred embodiments when considered in conjunction with the following drawings wherein:

FIG. 4 is a visual representation of an antenna head extension assembly retracted and extended;

DETAILED DESCRIPTION OF THE PREFERRED EMBODIMENTS

Figure 1:
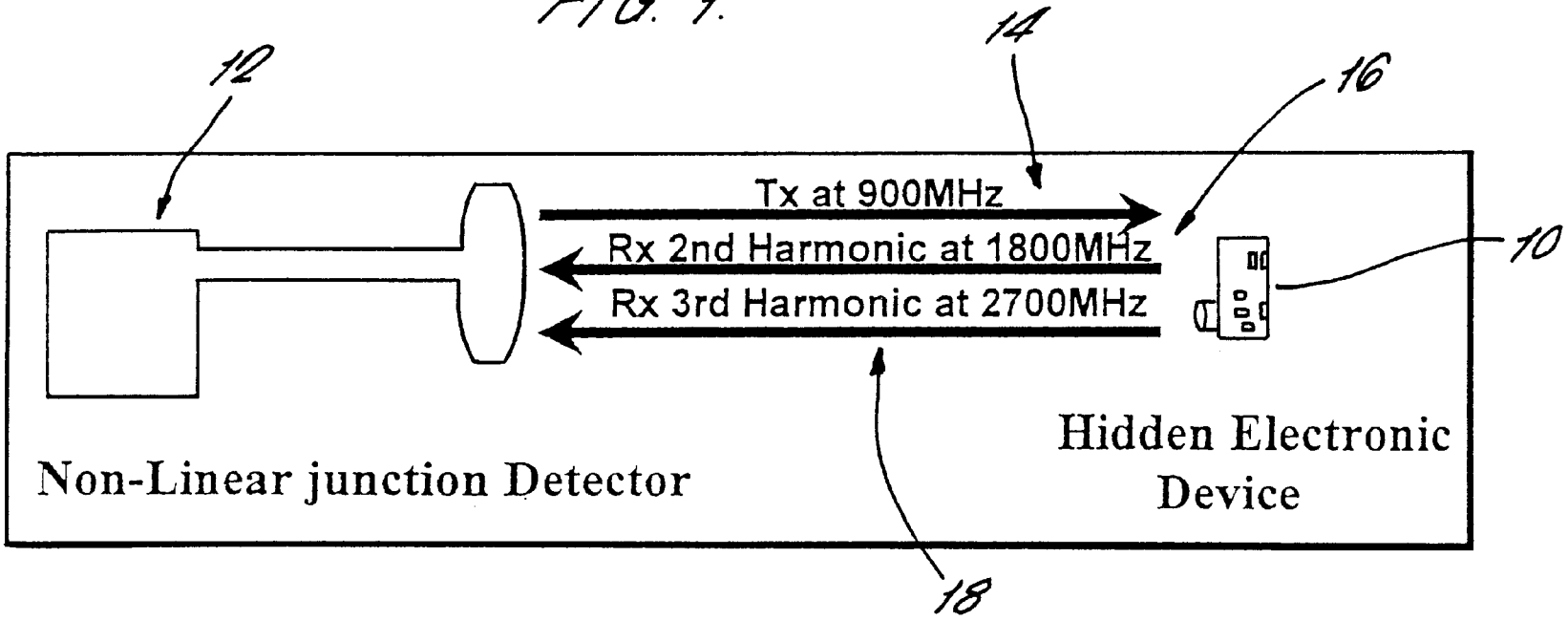
FIG. 1 is a functional diagram of the operation of a basic non-linear junction detector.

As previously discussed, a non-linear junction detector works on the principle that by radiating a non-linear junction with electromagnetic waves of sufficient power, detectable harmonics will be produced and re-radiated by the non-linear junction at frequencies that are integral multiples of the transmitted frequency. An example of how this principle would be used to detect the presence of a hidden electronic device 10 is shown in FIG. 1. In the example shown in FIG. 1, the non-linear junction detector 12 is transmitting electromagnetic radio waves 14 at a frequency of 900 Mega hertz (MHZ). The non-linear junctions found in the semiconductors used to construct the hidden electronic device 10 re-radiate second 16 and third 18 harmonic signals at the second and third harmonic frequencies of the transmitted radio waves 14. Thus, these harmonic signals 16 and 18 have a frequency that is equal to two and three times the frequency of the transmitted signal 14 respectively. The receivers of the non-linear junction detector 12 are tuned to receive signals in these harmonic frequency ranges. Thus, by detecting the presence of harmonic signals re-radiated by non-linear junctions, the non-linear junction detector 12 can detect the presence of a hidden electronic device 10.

Many non-linear junctions occur outside of electronic devices. For example, whenever two dissimilar metals are touching each other, a non-linear junction is formed. Because these non-linear junctions are not indicative of an electronic device, it is extremely beneficial to be able to distinguish between the harmonics re-radiated by a non-linear junction formed by a dissimilar metal junction and those re-radiated by a semiconductor non-linear junction found in an electronic device. An especially preferred embodiment of the present invention distinguishes between the two types of non-linear junctions by examining and comparing the amplitudes of the second and third harmonic signals. A semi-conductor non-linear junction re-radiates relatively strong second harmonics and relatively weak third harmonics. In fact, a dissimilar metal non-linear junction will tend to re-radiate much stronger signals at the third harmonic frequency than at the second harmonic frequency. Thus, by comparing the amplitude of the re-radiated second harmonic signal to the amplitude of the re-radiated third harmonic signal, the present invention can discriminate between the different types of non-linear junctions.

Figure 2A:
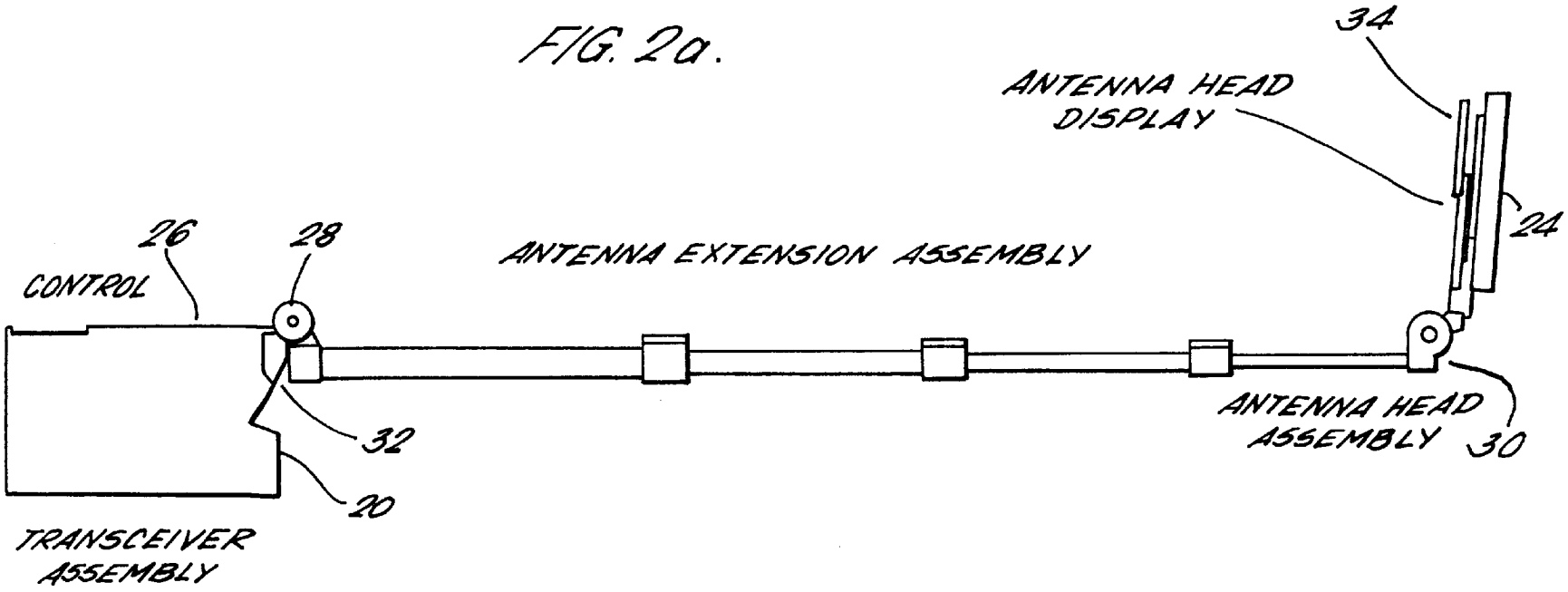
FIG. 2*a* is a visual representation of an embodiment of the improved non-linear junction detector in its operational configuration.
Figure 2B:
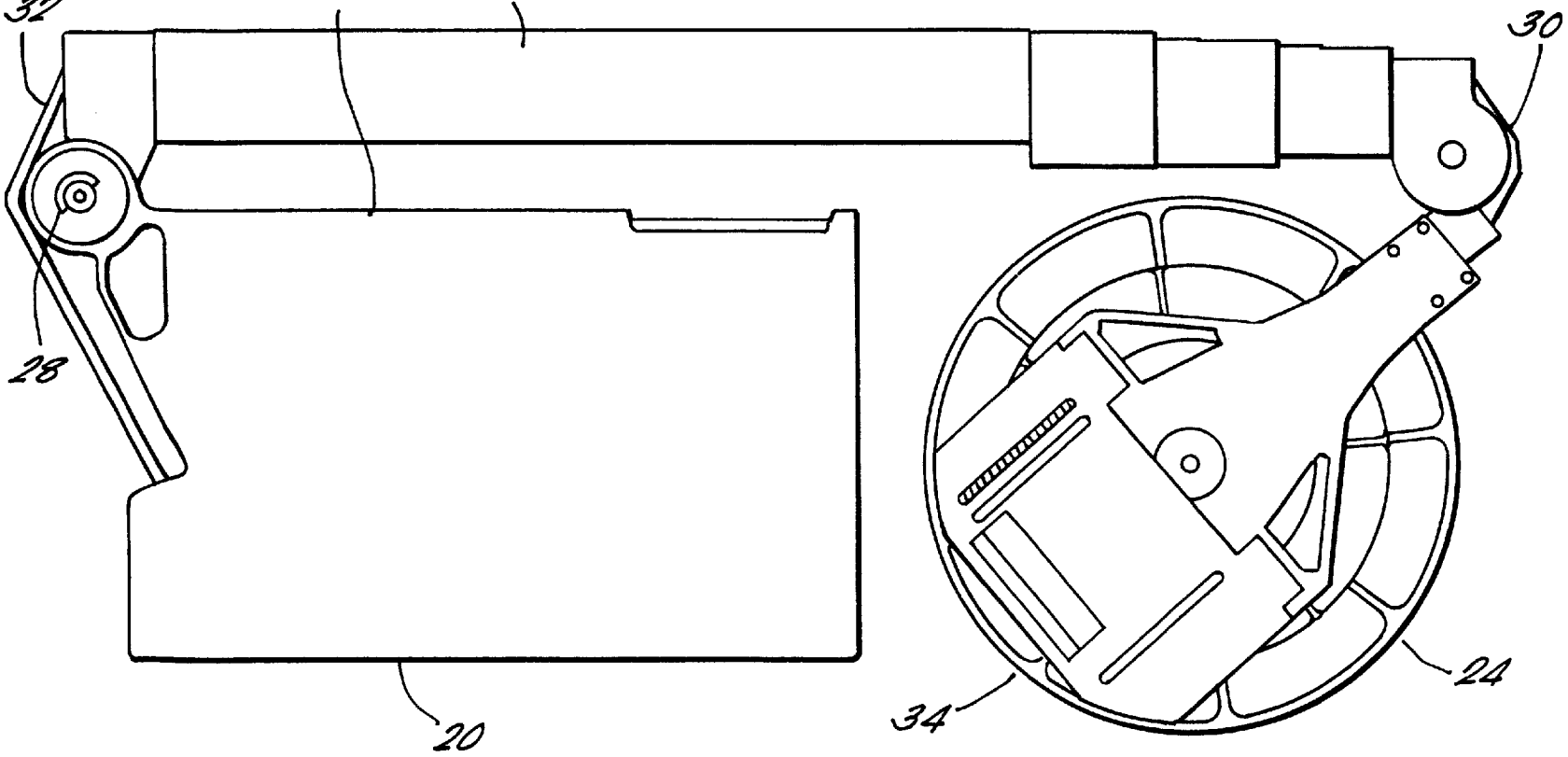
FIG. 2*b* is a visual representation of an embodiment of the improved non-linear junction detector in its stored configuration.
Figure 5:
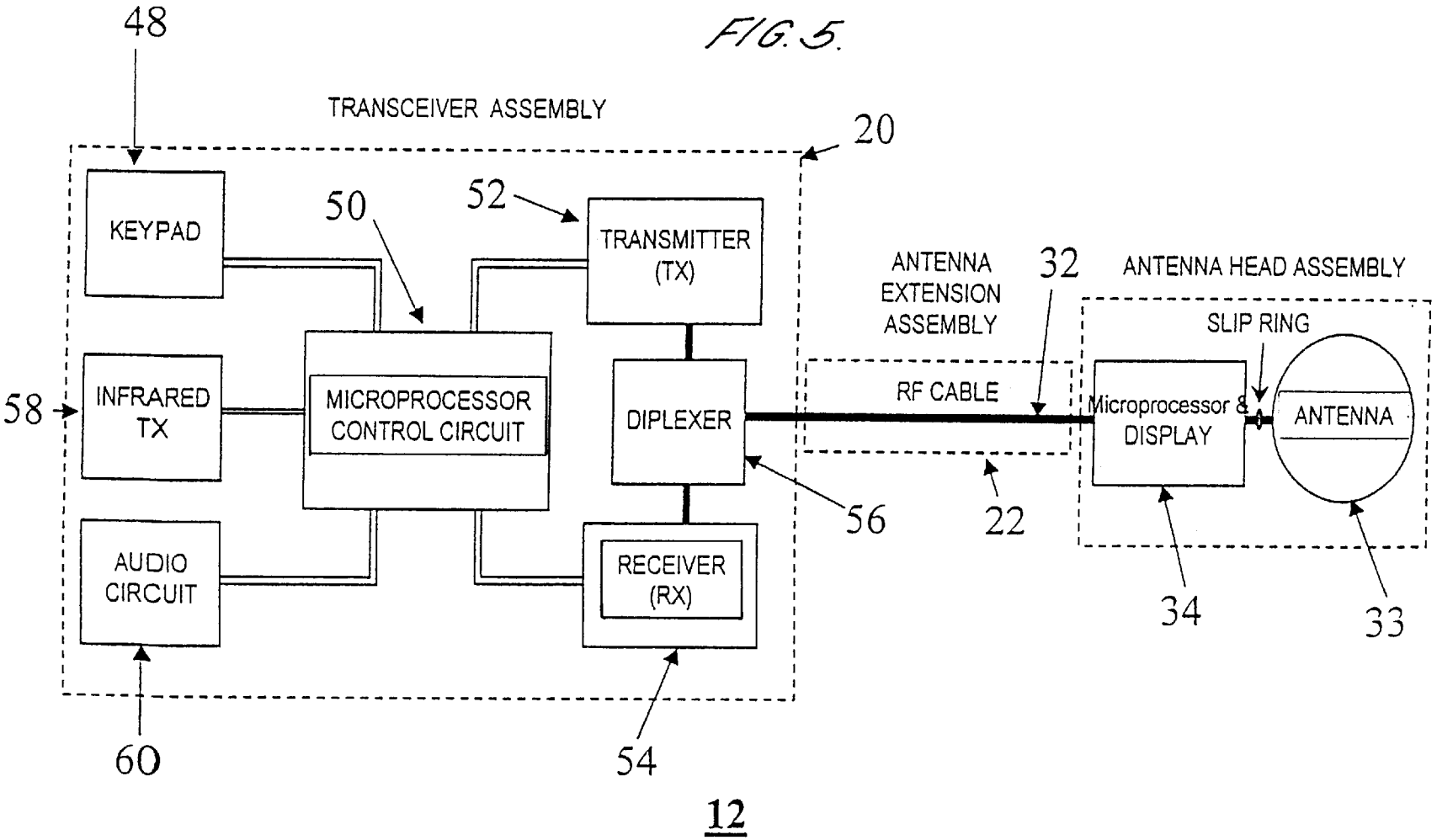
FIG. 5 is a block diagram of a preferred embodiment of the present invention.

FIG. 2*a* shows an especially preferred embodiment of the present invention. Basically, the non-linear junction detector 12 consists of a transceiver case 20, an extendable and retractable antenna extension assembly 22 and an antenna head assembly 24. The transceiver case 20 houses most of the electronic circuitry needed to implement the non-linear junction detector 12. Among other things, this electronic circuitry includes a transmitter 52, a receiver 54 and a microprocessor control circuit 50 as shown in FIG. 5. The transceiver case 20 also supports all the electrical connections and shielding requirements needed for the circuitry of the non-linear junction detector 12. Control buttons or switches 26 are provided on the transceiver case 20 to allow the user of the non-linear linear junction detector 12 to control its operation. The transceiver case 20 is rotatably connected to the extendable and retractable antenna extension assembly 22 by means of a connection joint 28. This connection joint 28 is designed to rest in two basic positions, the open position which is the normal operational position in which the transceiver case 20 is extended along the same axis as the antenna extension assembly 22, as shown in FIG. 2*a,* and the closed storage position in which the transceiver case 20 is folded so that the transceiver case 20 is parallel to the antenna extension assembly 22, as shown in FIG. 2*b*. The connection joint 28 is made up of a detent assembly so that at the two basic positions the connection joint 28 locks in place. To change the position of the connection joint 28, sufficient force must be exerted to overcome the detent ball and socket system.

An antenna head assembly connection joint 30 provides the mechanical interface between the antenna head assembly 24 and the extendable and retractable antenna extension assembly 22. The antenna head assembly connection joint 30 preferably provides dual axis of rotation for the antenna head assembly 24. The dual axis of rotation capability allows the antenna head assembly 24 to be rotated to fit in hard to reach places or around difficult corners. Furthermore, the antenna head assembly connection joint 30 is constructed so that it allows the electrically conductive cable 32 that provides an electrical interface between the electrical components of the transceiver case 20 and the antenna head assembly 24 to move into and out of the antenna head assembly 24 when extending and collapsing the antenna extension assembly 22. Preferably, the antenna head assembly 24 consists of an antenna 33 with a built in cord winder. The cord winder provides the mechanical function of winding the electrically conductive cable 32 into the cord winder when the antenna extension assembly 22 is collapsed and dispensing the cable 32 from the cord winder when the antenna extension assembly 22 is extended. When the antenna extension assembly 22 is retracted or extended, the antenna head assembly 24 of a preferred embodiment rotates as the cord winder either collects or dispenses the electrically conductive cable 32. As discussed in more detail later with regards to FIG. 9, a slip ring assembly 108 is used to extract the electronic Inputs for the antenna head display 34. The contacts for the slip ring 108 are fixed to the antenna head display 34 circuitry while the slip ring 108 is connected to the cord winder. Thus, electrical contact between the antenna head assembly 24 electronics and the electrically conductive cable 30 is maintained as the antenna head assembly 24 rotates.

Figure 3:
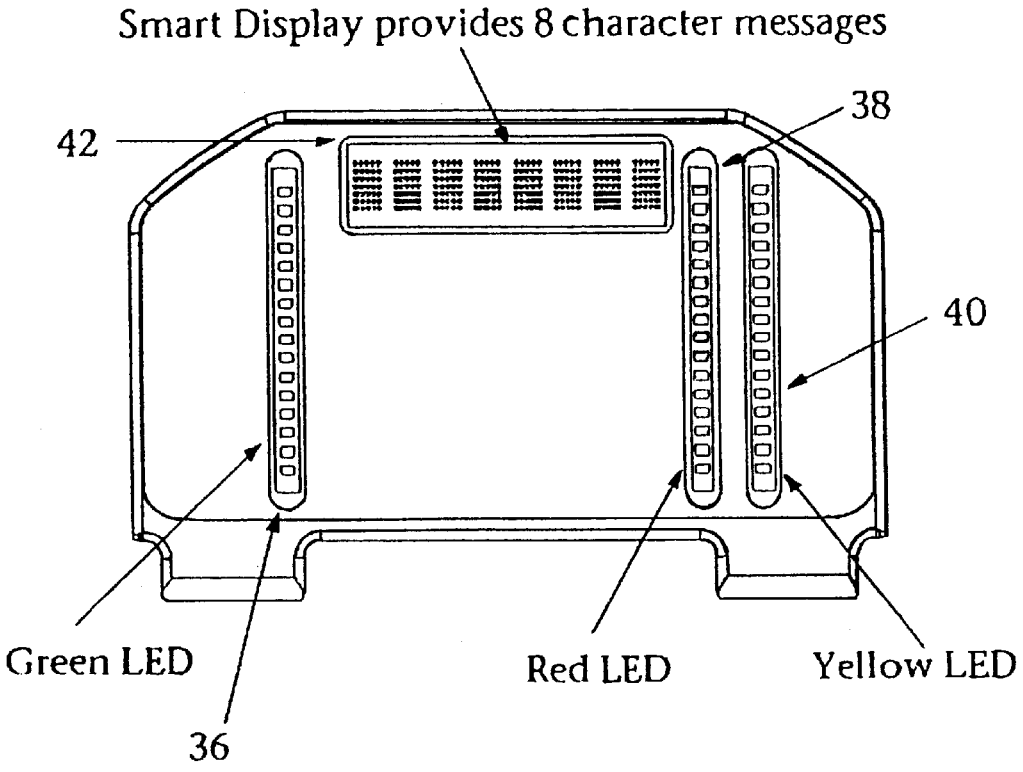
FIG. 3 is a visual representation of a preferred antenna head assembly display.

The antenna head assembly 24 has an antenna head display 34 that provides information to a user of the non-linear junction detector 12 concerning the presence of any non-linear junctions. A close up and detailed view of the antenna head display 34 is depicted in FIG. 3. The antenna display 34 preferably has three light emitting diode (LED) bar graphs 36, 38 and 40 and an eight character alphanumeric display 42. The LED bar graphs 36, 38 and 40 graphically display the strength of the second harmonic return signal 38, the strength of the third harmonic return signal 40, and the strength of the transmitted signal 36. The antenna display 34 is discussed in more detail below, however, it is understood that the invention is not limited to the particular antenna display 34 configuration discussed. Furthermore, it is understood that embodiments of the invention might place the display 34 in other locations, such as on the transceiver case 20.

The antenna extension assembly 22 is shown as a retracted assembly 44 and extended assembly 46 in FIG. 4. The antenna extension assembly 22 consists of a telescoping pole which has the transceiver case assembly connection joint 28 on one end and the antenna head assembly connection joint 30 on the other end. The telescoping extension assembly 22 is preferably hollow inside and houses the electrically conductive cable 26 that connects the electronics contained in the transceiver case 20 to the electronics contained in the antenna head assembly 24. When fully collapsed, in one embodiment the antenna extension 22 is 17 inches long and, when fully extended, the antenna extension 22 is 54 inches long. However, it is readily appreciated that the antenna extension 22 could be designed in a variety of sizes.

As shown in FIG. 5, a preferred embodiment of the non-linear junction detector 12 conceptually consists o)f three main assemblies: the transceiver case assembly 20, the antenna extension assembly 22, and the antenna head assembly 24. Block diagrams can be used to represent the components and functioning of these assemblies 20, 22 and 24. The transceiver case assembly 20 preferably houses a key pad 48 that allows the user to enter various commands that control the functioning of the non-linear junction detector 12. Other types of user interfaces such as dials or switches are within the scope of the present invention, however, a key pad 48 is preferred.

The commands entered on the key pad 48 are sent to the microprocessor control circuit 50. A preferred microprocessor for use in the microprocessor control circuit 50 is a mc68hc711e9 manufactured by Motorola and other manufacturers. However, it is understood that a wide variety of microprocessors could be used to implement the microprocessor control circuit 50. When the non-linear junction detector 12 is turned on and the proper operational mode is initiated, the microprocessor control circuit 50 prompts the transmitter 52 to begin transmitting signals. These signals are carried by the electrically conductive cable 32 housed in the antenna extension assembly 22 to the antenna 33 where they are broadcast. Harmonic signals that are re-radiated from a non-linear junction in response to the transmitted signals are then received by the antenna 33. These harmonic signals are carried by the electrically conductive cable 32 to the diplexer 56. The diplexer 56 allows the relatively high frequency harmonic signals to enter the receiver 54 while preventing the relatively low frequency transmitted signals from entering the receiver 54.

The receiver 54 produces a received signal strength indicator signal and an encoded audio signal based on the signal strength of the received harmonic signals 16 and 18. These signals are sent to the microprocessor control circuit 50. The microprocessor control circuit 50 processes the received signal strength indicator signal and sends the appropriate commands to the antenna head display 34 to direct the display 34 to display the strength of the received signals. The encoded audio signals are processed by the microprocessor control circuit 50 which produces an audio output signal that is sent to an audio circuit 60 and an infrared transmitter 58 that is preferably in communication with a pair of cordless infrared headphones. The sounds produced by the audio circuit 60 and the headphones allow the user to audibly detect the presence of a non-linear junction. While infrared headphones are the preferred way to provide the audible signals to an operator of the non-linear junction detector 12, it is understood that a variety of different speakers and headphones could be used to broadcast the audio signals.

In one especially preferred embodiment, the audio output at least consists of two different audio tone signals. Each audio tone corresponds to the signal strength of either the second 16 or third harmonic signal 18. Thus, listening to the audio signals provides the user of the non-linear junction detector 12 a relative indication of the strength of the second and third harmonic receive levels. This is beneficial because, as previously discussed, semi-conductor non-linear junctions can be distinguished from dissimilar metal non-linear junctions by examining the amplitudes of the second and third harmonics.

In another preferred embodiment, the non-linear junction detector 12 may rely on demodulated audio noise as a method of discriminating between semi-conductor and dissimilar metal non-linear junctions. The received harmonic signals 16 and 18 are demodulated using normal audio demodulation techniques such as AM or FM demodulation. The harmonic signals re-radiated by a semi-conductor junction contain very little audio noise because the signals are pure harmonic reflections of the transmitted signal. Thus, the operator will hear little if any noise if the harmonic signals from a semiconductor non-linear junction are audibly reproduced. However, the harmonic signals produced by a dissimilar metal junction tend to contain a lot of audio noise. Thus, if the harmonic signals produced by a dissimilar metal junction are demodulated, relatively large amounts of audio noise will be present. Thus, an operator of the non-linear junction detector 12 will hear a much louder audible noise response if a dissimilar metal non-linear junction re-radiated the harmonic signals than if a semi-conductor non-linear junction re-radiated the harmonic signals. In a preferred embodiment, the non-linear junction detector uses a pulsing approach to perform the demodulation of the listening mode. This preferred embodiment transmits pulses at a 20 KHz pulse rate and a duty cycle such that the FCC part 15 radiated power levels are not exceeded. Since the 20 KHz pulse rate is above normal hearing frequencies, the audio can be easily demodulated using normal AM demodulation techniques. It is understood that a variety of different methods may be used to perform the demodulation of the received signal.

One of these signal identification techniques used with the invention may involve comparing the received harmonic signals 16 and 18 to known representations of harmonic signals 16 and 18 that were re-radiated from known types of electronic devices. For example, certain types of electronic devices 10 re-radiate harmonic signals 16 and 18 that contain distinctive variations in the originally transmitted signal 14. When harmonic signals 16 and 18 are received, the harmonic signals 16 and 18 are demodulated to isolate the variations in the harmonic signals 16 and 18 from the originally transmitted signal 14. If these demodulated signals are examined, the type of device re-radiating the harmonics may be discernable. The demodulated signals re-radiated from operating video cameras will typically contain synchronization pulses having a frequency of approximately 15 KHz. The presence of such synchronization pulses suggests detection of a video camera. By closely examining the frequency of the synchronization pulses, it may even be possible to distinguish between cameras using different types of video recording formats.

The demodulated signals discussed above can also be sent directly to the headphones or audio circuit 60 of the nonlinear junction detector 12 to allow the operator to audibly distinguish between the different types of devices. Different types of non-linear junctions almost invariably produce distinctive sound patterns when demodulated as discussed above. For example, the signals re-radiated from audio recording devices are often extremely distinctive. If an audio recording device is operating, sending the demodulated signals re-radiated from the device directly to headphones or audio circuit 60 of the non-linear junction detector 12 flay allow the user of the non-linear junction detector 12 to actually listen to the audio signals from the tape recording heads of the recording device and hear exactly what the device is recording. However, even if the actual audio signal from the audio recorder can not be received, a trained user may learn to recognize the noise patterns created by the particular types of non-linear junctions that tend to be present in an audio recording device.

Yet another means of discriminating between different types of non-linear junctions, and thus reducing the number of false alarms, involves varying power of the transmitted signal 14 and examining the change in the amplitudes of the received harmonic signals 16 and 18 in response to the change in the amplitude of the transmitted signal 14. The transmitter 52 output power level can be altered by using the microprocessor control circuit 50 to vary the gain of the power amplifier 74. The change in amplitude in the received harmonic signals 16 and 18 can be examined digitally with the microprocessor control circuit 50, audibly with the infrared transmitter 58 and the audio circuit 60, or visually through use of a graphical display 34. In effect, varying the transmitter 52 power level allows a user of the non-linear junction detector 12 to examine the non-linear response of the non-linear junctions. Non-linear junctions, such as those found in electronic devices such as a diode, tend to have non-linear responses that occur at constant and predictable transmitted signal 14 power levels. By repeatedly increasing the power of the transmitted signal 14, a user will notice a strong increase in the amplitude of the re-radiated harmonic signals 16 and 18 every time the power of the transmitted signal 14 exceeds a certain level. This type of amplitude response is indicative of a semi-conductor non-linear junction. However, dissimilar metal junctions have non-linear responses that tend to be unpredictable and vary a great deal. Thus, if the amplitude of the received harmonic signals 16 and 18 tends to vary unpredictably and the variations tend to occur at different transmit power levels when the transmit power is repeatedly increased and decreased, the non-linear junction is more than likely caused by a dissimilar metal junction. As previously stated the non-linear responses created by the non-linear junctions can be provided to the operator of the non-linear junction detector 12 in a variety of ways including visually and graphically displaying them on a display, or audibly representing the amplitude of the signals through headphones or an audio circuit 60.

Figure 6:
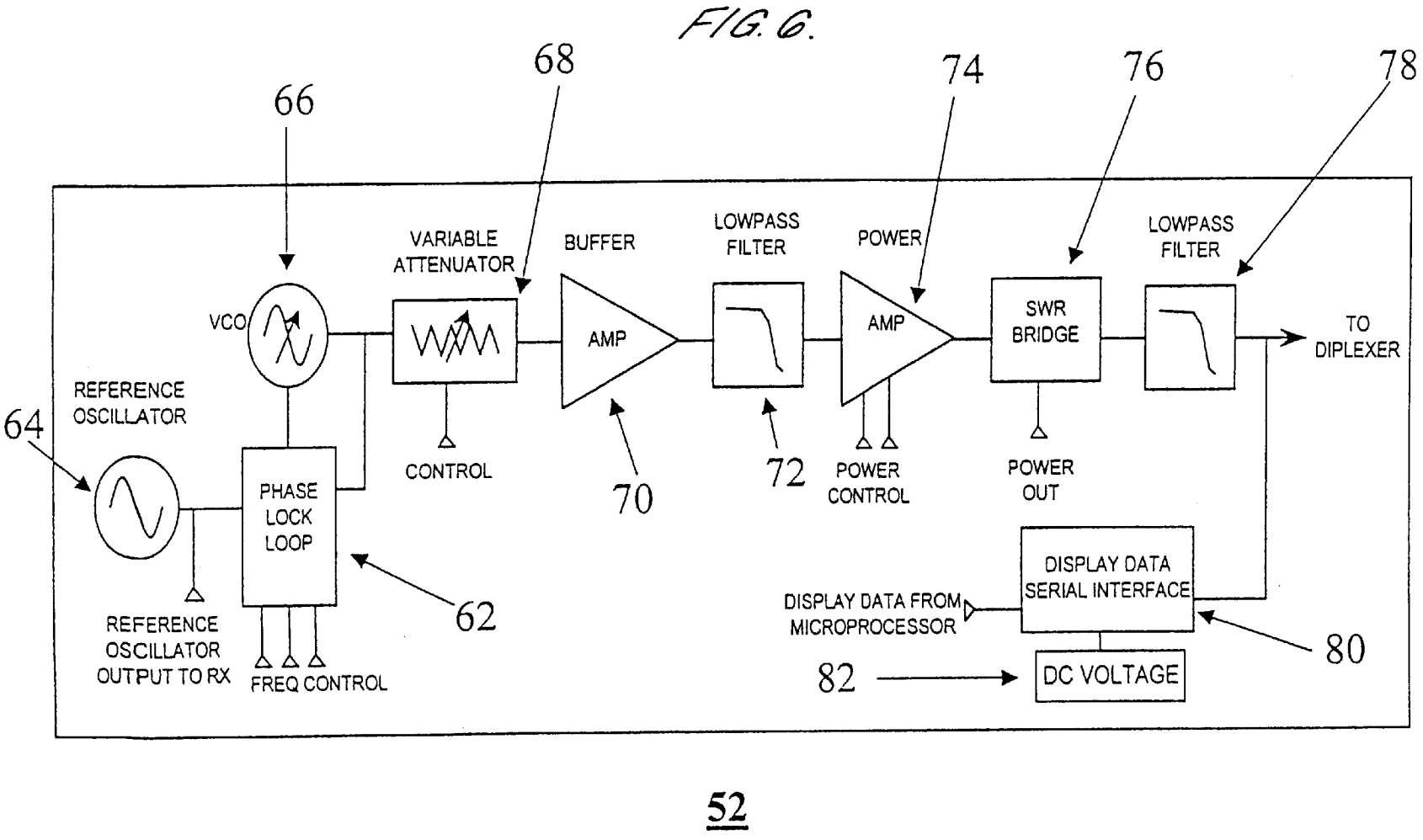
FIG. 6 is a block diagram of a preferred transmitter.

The transmitter 52 produces the transmit signals 14 which are broadcast by the antenna head assembly 24. A block diagram of the internal functioning of a preferred transmitter 52 is depicted in FIG. 6. The transmitter 52 contains a phase locked loop frequency synthesizer 62 which generates the fundamental transmit frequency. A reference oscillator 64 provides a reference frequency to the phase locked loop 62. The reference oscillator 64 is also used as a reference oscillator 64 for the receiver 50. The reference oscillator 64 in this particular embodiment has a frequency of 6.4 MHZ but other frequencies could be used. A voltage controlled oscillator 66 provides the transmit signal 14 to the phase locked loop 62. The voltage controlled oscillator 66 and the phased locked loop 62 are controlled by control signals provided from the microprocessor control circuit 50. Prior to amplification, the transmit signal's amplitude is controlled by a variable attenuator 68 which also receives control signals from the microprocessor control circuit 50. The output from the variable attenuator 68 is buffered by an amplifier 70 and then passed through a low pass filter 72 to remove any high frequency components generated by the transmitter 52. Alter passing through the low pass filter 72, the signal is amplified by a power amplifier 74 which preferably provides an output power level of either 1 milliwatt, 10 milliwatts, 100 milliwatts, or 1 watt depending on the control signals received from the microprocessor control circuit 50. The output signal from the power amplifier 74 is sent to a single wave rectifier bridge 76 which provides an output power level to the microprocessor control circuit 50. The microprocessor control circuit 50 processes the output power level signal and sends commands to the antenna head display 34 to provide an output power level indication to the user of the non-linear junction detector 12. The signal from the single-phase wave rectifier bridge 76 is then passed through another low pass filter 78. As previously discussed, low pass filtering the transmit signal prevents high frequency harmonics of the transmitted signal from entering the antenna head assembly 24 and interfering with the reception of the re-radiated harmonic signals 16 and 18. After passing through the final low pass filter 78, an amplitude modulated signal containing the display data for the antenna head display 34 from the microprocessor control circuit 50 is added to the transmitter output by a serial interface 80. Finally, a DC voltage 82 that is the power supply for the antenna head display 34 is added to the transmitted signal and the display data and sent to the antenna head display 34.

Current non-linear junction detectors transmit a signal having a relatively constant power level. However, in accordance with the present invention, the transmitter 52 is designed to provide a pulsing transmit function as well as variable power level control. In one embodiment, the transmit waveform has a 7.5% duty cycle, but other duty cycles can be used. This means that the transmit signal is at a predetermined power level for 7.5% of the time and is turned off for the other 92.5% of the time. In this embodiment this translates into a 1.5 msec transmit pulse during which the power amplifier 74 is enabled followed by 18.5 msec time period during which the power amplifier 74 is disabled and, consequently, no transmit pulse at all is produced. This is very beneficial in that FCC requirements state that a non-linear junction detector can produce a maximum average power 75 milliwatts. Thus, if the non-linear junction detector 12 produces a transmit signal 14 that has a constant power, the maximum power level of the signal allowed by law is 75 milliwatts. However, if the transmit signal 14 only has a duty cycle of 7.5%, the power of the transmit signal 14 during its duty cycle can be 1 watt and the average power of the signal will still be only 75 milliwatts. Thus, pulsing the transmitter 52 allows the non-linear junction detector 12 to produce a more powerful and effective transmit signal 14 while still remaining in compliance with the requirements imposed by law. In addition, non-linear junction detectors are typically powered by an internal power supply that allows the non-linear junction detector 12 to be portable. Pulsing the transmitter 52 allows the non-linear junction detector 12 to enjoy the benefits of a high powered transmit signal 14 without increasing the power consumption of the non-linear junction detector 12. It is appreciated that there are an infinite number of different pulse widths and duty cycles that could be chosen that would provide the benefits of increased maximum power and decreased power consumption and the present invention is not limited to any particular pulse width or duty cycle.

Figure 7:
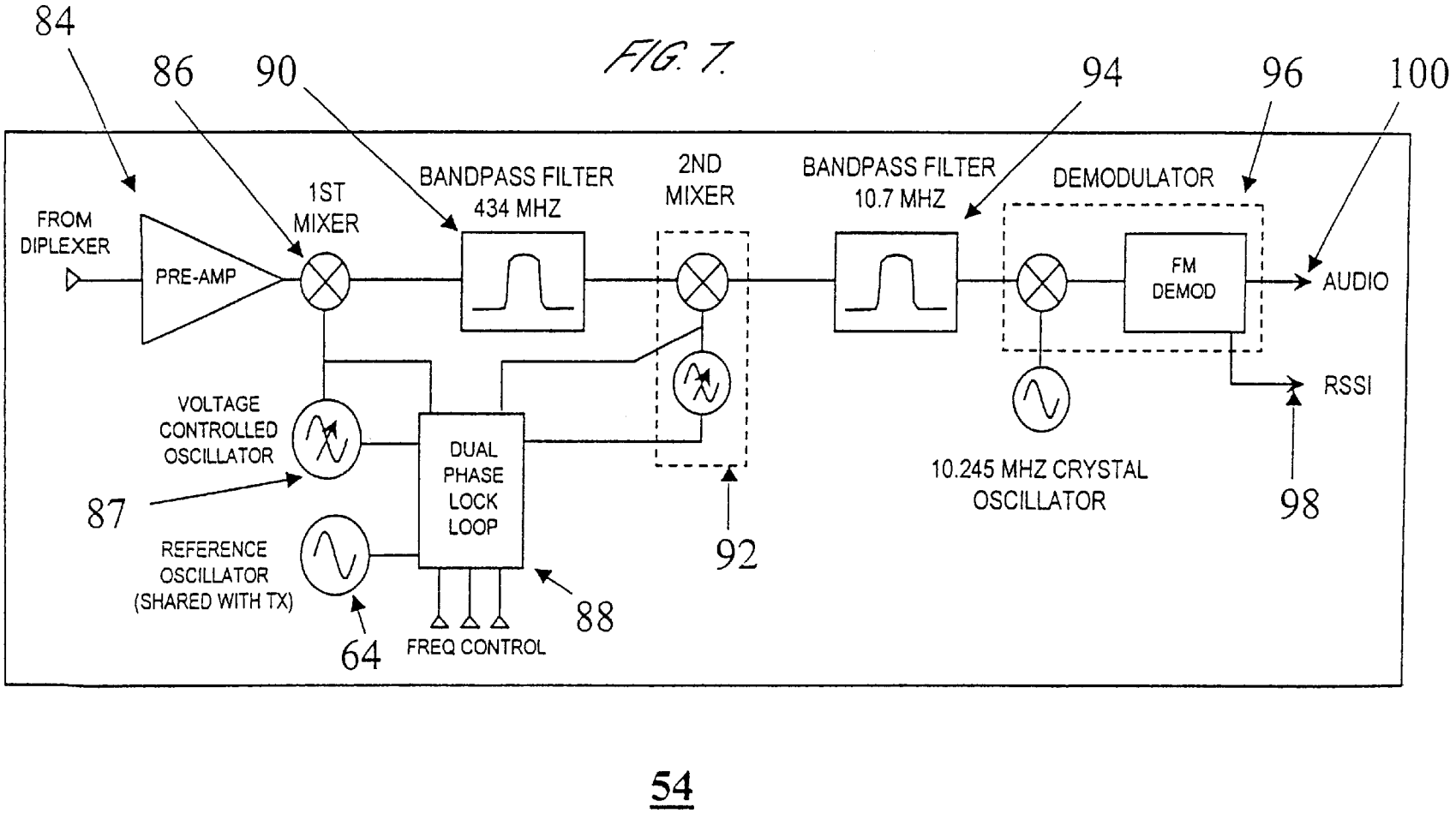
FIG. 7 is a block diagram of a preferred receiver.

Referring back to FIG. 5, the receiver 54 is shown as being in electrical communication with the microprocessor control circuit 50 and the diplexer 56. A block diagram of the internal functions of the receiver 54 is shown in FIG. 7. The received signal from the antenna head assembly 24 is provided to the receiver 54 by the diplexer 56. A particularly preferred receiver 54 design consists of two main down conversions in frequency prior to a 10.7 MHZ demodulator 96. The receive signal from the diplexer 56 is amplified by a pre-amp 84 prior to the first down conversion. The signal received from the diplexer 52 is then down converted to an intermediate frequency by a first mixer 86. The mixer 86 takes the received signal and combines it with a signal from the dual phase locked loop 88 to produce a modulated intermediate frequency signal. The intermediate frequency is preferably set to a frequency value that is slightly less than half the difference between the second and third harmonic frequencies. The dual phase locked loop 88 in the receiver 54 shares a reference oscillator 64 with the transmitter 52 and provides the local oscillator for both down conversions. The first down conversion provides the capability to receive either the second or third harmonic of the receive signal. In order to receive an upper image of the second harmonic signal 16, the frequency of the voltage controlled oscillator 87 is set to a frequency slightly below an intermediate frequency that is between the frequency of the second harmonic signal 16 and the frequency of the third harmonic signal 18. To receive a lower image of the third harmonic signal 18, the voltage controlled oscillator 87 is set to a frequency slightly above the intermediate frequency between the second harmonic frequency and the third harmonic frequency. By toggling the frequency of the voltage controlled oscillator 87 between a frequency slightly above the intermediate frequency and a frequency slightly below the intermediate frequency, a single receiver 54 can be used to receive both the second 16 and third 18 harmonic signals. This is a significant improvement over the prior art in that it is less complex and expensive than an approach which utilizes a separate antenna or separate channels to receive both the second 16 and third 18 harmonic signals.

The toggled receiver 54 that tunes to at least two harmonic frequencies can be used with either a pulsed transmission or a constant frequency wave non-linear junction detecting system. Furthermore, the receiver 54 can be toggled between the harmonic frequencies when no signals are being transmitted to measure the level of ambient noise present at the harmonic frequencies to determine if an alternative transmission frequency should be employed. The microprocessor control circuit 50 controls the frequencies between which the receiver toggles by sending control signals to the voltage controlled oscillator 87. Thus, if too much ambient noise is present at the two frequencies, the microprocessor control circuit 50 can simply send control signals to the transmitter's voltage controlled oscillator 66 and the receiver's voltage controlled oscillator 87 that adjust the transmitter and receiver frequencies respectively. This digitally synthesized frequency control allows the non-linear junction detector 12 to alter is functioning to avoid noisy frequencies and comply with differing governmental regulations and is a significant improvement over prior art non-linear junction detectors.

After the first down conversion, the mixed signal from the first mixer 86 is filtered by a bandpass filter 90 centered around the intermediate frequency of the first mixer 86. After the band pass filter 90, the mixed signal is sent to a second mixer 92. The mixer 92 in the second down conversion brings the mixed signal down to the 10.7 MHZ final intermediate frequency. The mixed signal is then passed through a second bandpass filter 94 that is centered around the intermediate frequency of the second mixer 92. The filtered signal is then frequency demodulated by a demodulator 96 to produce a received signal strength indicator output 98 that is read by an analog to digital converter in the microprocessor control circuit 50. The microprocessor control circuit 50 provides this information to the antenna head display 34. The demodulator 96 also produces an audio output 100 that can be used to provide audible signals representing the strength of the received harmonic signals 16 and 18.

As an example of the functioning of the receiver 54 of FIG. 7, suppose the transmit frequency of the non-linear junction detector was set to 900 MHZ. The frequency of the received second harmonic signal 16 re-radiated by a non-linear junction would thus be 1800 MHZ and the frequency of the received third harmonic signal 18 would be 2700 MHZ. The intermediate frequency is set to a value that is equal to slightly less than half the difference between the second and third harmonic frequencies. In our example, the difference is 900 MHZ so the intermediate frequency would be set to about 445 MHZ which is slightly less than half the difference between the harmonic frequencies. To receive the second harmonic signal 16 the voltage controlled oscillator's 87 oscillation would be set to 2234 MHZ which is equal to the second harmonic frequency, 1800 MHZ, plus the intermediate frequency, 434 MHZ. To receive the third harmonic signal 18, the oscillation of the voltage controlled oscillator 87 is set to 2266 MHZ which is equal to the third harmonic frequency, 2700 MHZ, minus the intermediate frequency of 434 MHZ. Thus, by toggling the frequency of the oscillator 87, multiple signals at different frequency ranges can be received on a single receiver 54. The rate of toggling between frequencies is preferably rapid enough to make reception of the individual signals appear continuous to the user of the non-linear junction detector 12. While, the above discussion was limited to receiving signals from two frequency ranges, it is appreciated that the frequencies of the receiver 54 could be set to receive more than two signals including higher level harmonic frequencies, such as the fourth and fifth harmonics, of the transmitted signal.

Figure 8:
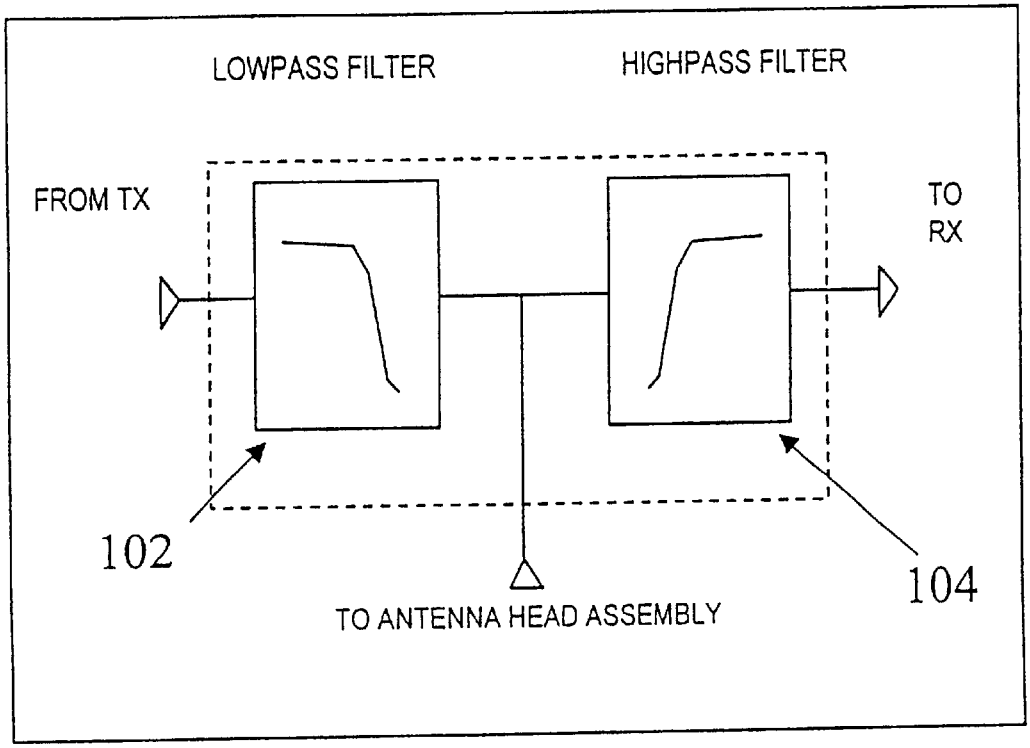
FIG. 8 is a block diagram of a preferred diplexer.

Referring now to FIG. 8, a block diagram of the diplexer 56 is depicted. The diplexer 56 performs the function of separating the transmit signal 14 from the receiver 54 so that a single cable and a single antenna design can perform all of the functions of the non-linear junction detector 12. The diplexer 56 preferably consists of a low pass filter 102 that prevents any harmonic signals being generated by the transmitter 52 from entering the electrically conductive cable 32 and interfering with the reception of the re-radiated harmonic signals 16 and 18 and a high pass filter 104 that prevents the relatively low frequency transmitted signal from entering the receiver 54. As discussed in more detail directly below, the DC power supply voltage 82 that is used to power the antenna head assembly 24 and the low frequency modulated serial commands that control the antenna head display 34 also pass through the low pass filter 102 and propagate toward the antenna head assembly 24.

Figure 9:
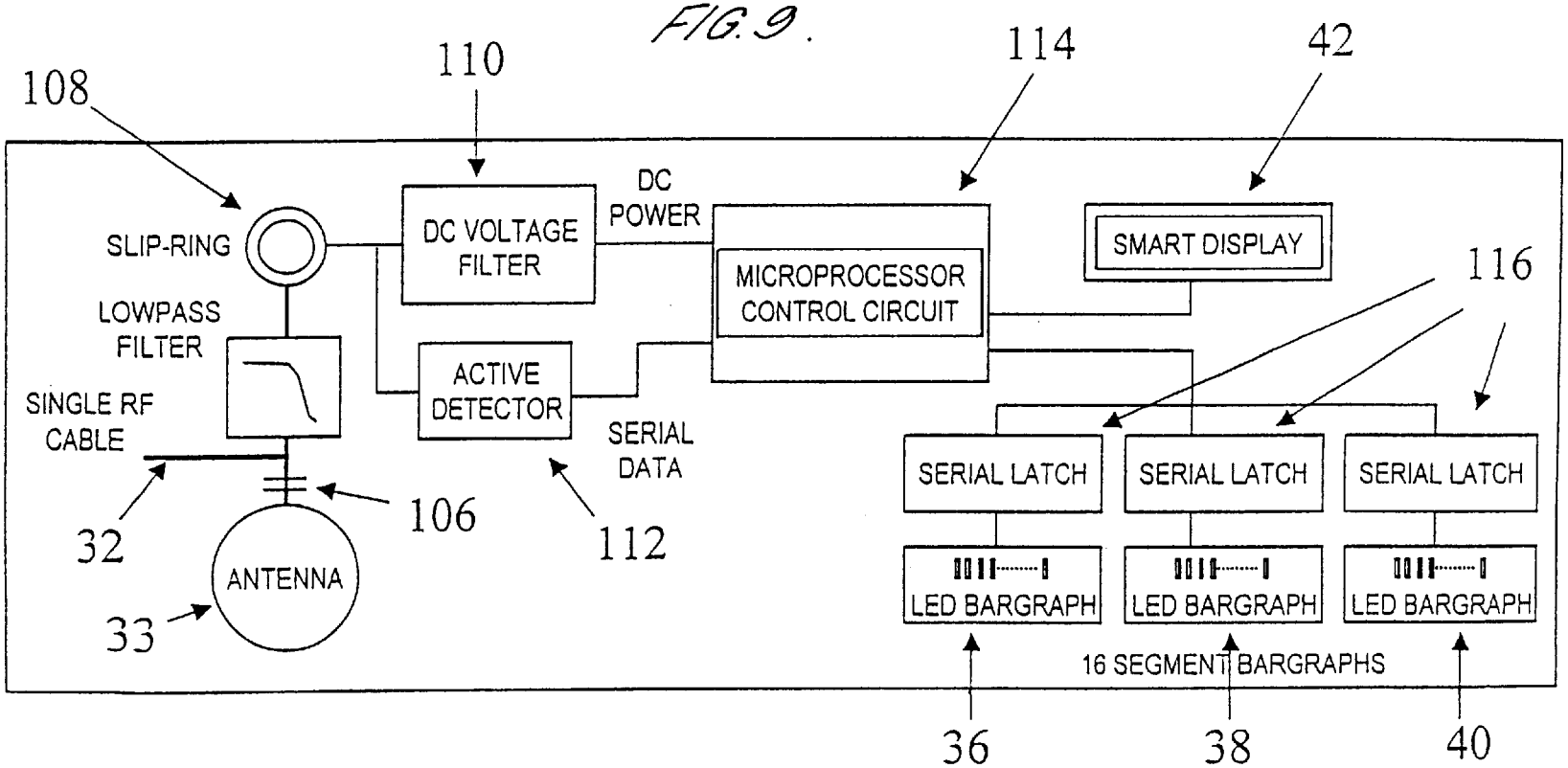
FIG. 9 is a block diagram of a preferred display and associated electronics.

A block diagram of the antenna head assembly 24 is shown in FIG. 9. The antenna head assembly 24 contains the antenna 33 and all the electronics needed for the antenna head display 34. A single electrically conductive cable 32 is connected to the antenna 33 through a coupling capacitor 106. The coupling capacitor 106 prevents the DC power supply voltage 82 and the low frequency serial commands for the antenna head display 34 from reaching the antenna 33. The single electrically conductive cable 32 is also connected directly to a slip ring 108. The slip ring 108 provides an electrical path between the electrically conductive cable 32 and the antenna head assembly 24 electronics. A DC voltage filter 110 is used to separate the DC power supply voltage 82 needed to power the display electronics. A low pass filter 112 is used to separate the low frequency serial commands used to control the display 42 from any high frequency signals received from the antenna 33. A second microprocessor control circuit 114 located in the antenna head assembly 24 interprets the serial commands and provides digital outputs for the eight character alphanumeric display 42 and the LED bar graphs 36, 38 and 40 of the antenna display 34. Serial latches 116 are used to form an interface between the second microprocessor control circuit 114 and the LED bar graphs 36, 38 and 40. The eight character alphanumeric display 42 is used to provide informational messages concerning the functioning of the non-linear junction detector 12 to the user of the detector 12. In one mode of operation, the bar graphs 36, 38 and 40 are used to display indications of the transmit power level, received second harmonic power level and received third harmonic level respectively. In another mode of operation, the red bar graph 38 is used to display the difference between the second and third harmonic levels, and the yellow bar graph 40 shows the normalized sum of the second and third harmonics. Bar graph 36 remains the same.

Figure 10:
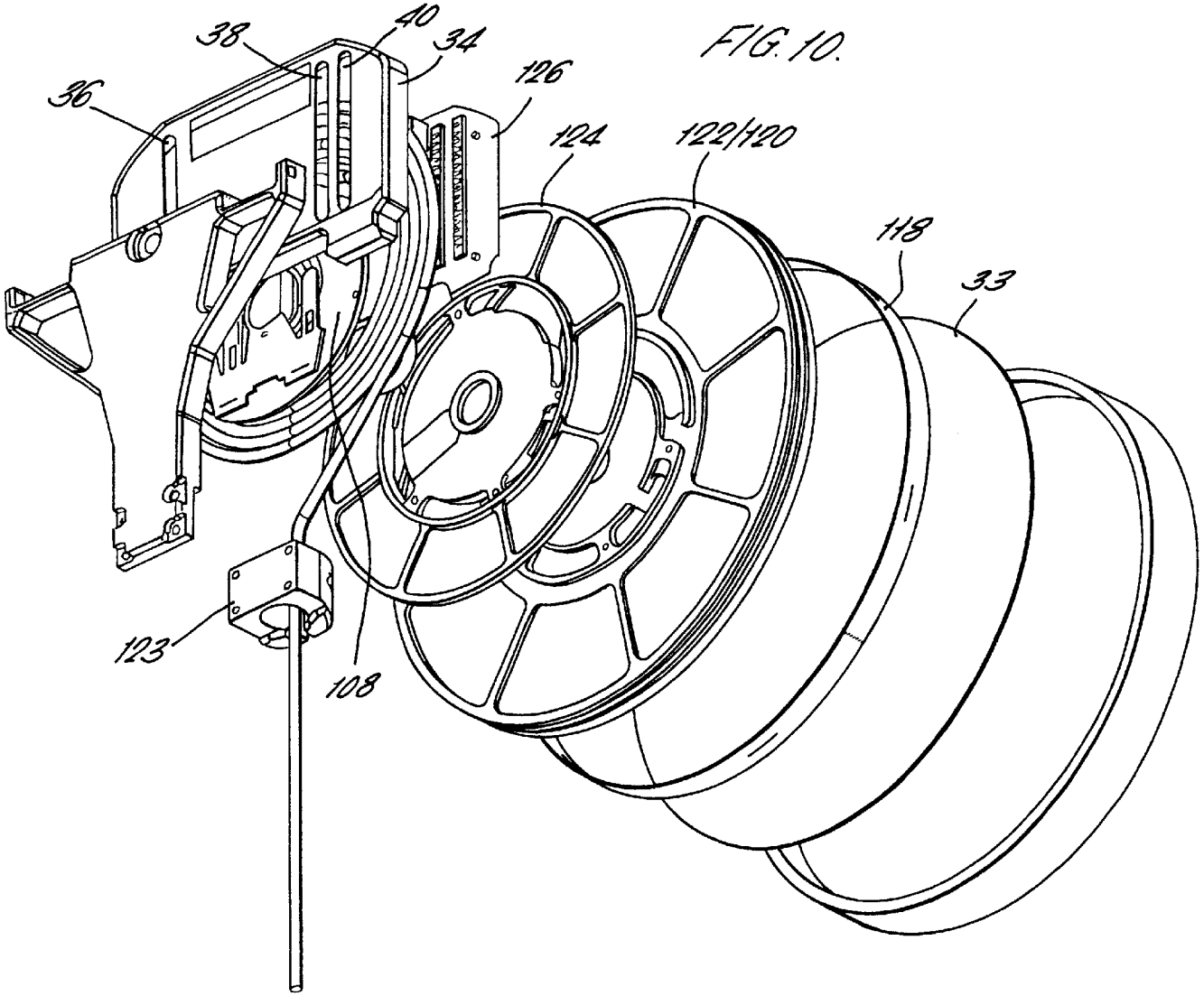
FIG. 10 is an exploded view of an antenna head assembly of a preferred embodiment.

An exploded view of a preferred embodiment of the antenna head assembly 24 is shown in FIG. 10. The antenna 33 is preferably a circularly polarized antenna that was designed by the University of Michigan and is disclosed in PCT application number PCT/US96/20500. The antenna 33 is held in place by a circular ring 118 that connects to the antenna back ground plane 120. The antenna back ground plane 120 is connected to the antenna side 122 of the cord winder. The cord winder has an antenna side 122 and a display side 124. The two sides of the cord winder 122 and 124 form a spool onto which the cord is wound. A spring biases the cord winder so that any slack in the electrically conductive cable 32 is immediately removed. A set of connectors and guides 123 remove and provide cord from the cord winder to the antenna extension assembly 22. A slip ring 108 fits between the display side 124 of the cord winder and the display head control board 126. As previously discussed, the slip ring 108 establishes an electrical path between the display 34 and the electrically conductive cable 32. The display 34 is connected to the display head control board 126. The display head control board 126 provides electrical contact between the slip ring 108 and the display 34 and secures the display 34 in place. The display 34 has three bar graphs 36, 38 and 40 that are preferably used to display the amplitudes of the transmitted signal 36, second harmonic signal 38 and third harmonic signal 40 respectively.

As can be appreciated from the preceding discussion, the provision of a non-linear junction detector 12 that uses a single circularly polarized antenna 33 is a significant improvement over the prior art. The retractable and extendable antenna extension assembly 22 allows the device to easily reach awkward areas where surveillance devices may be hidden. In addition, the collapsible structure and light weight of the non-linear junction detector allows it to be conveniently carried to remote locations. Furthermore, when the advanced electronic signal processing techniques of the present invention are used in conjunction with the circularly polarized transmit signals, the likelihood an electronic device will not be detected or falsely identified is substantially decreased. Many substantial improvements in the prior art are embodied in the present invention. Thus, while specific embodiments of the invention have been described with particularity above, it will be appreciated that the invention comprehends rearrangement and substitution of parts within the spirit of the appended claims.

What is claimed is:

1. An electronic device for detecting the presence of non-linear junctions, the electronic device comprising:

a transmitter for producing a transmit signal having an amplitude;

a single circular polarized antenna that is electrically connected to the transmitter so that the single antenna receives the transmit signal from the transmitter and produces electromagnetic waves that radiate outward from the single antenna and wherein the single antenna produces at least one re-radiated harmonic signal in response to electromagnetic waves that have been re-radiated by a non-linear junction in response to the electromagnetic waves produced by the single antenna; and a receiver that is electrically connected to the single antenna so that the receiver receives the at least one re-radiated harmonic signal from the antenna and produces a conditioned harmonic signal.

2. The device of claim 1 wherein a single electrically conductive cable electrically connects the transmitter and receiver to the single antenna.

3. The device of claim 2 further comprising a diplexer for electrically connecting the transmitter and receiver to the single antenna and isolating the transmitted signal from the receiver so that any harmonic signal generated by the transmitter will not interfere with receiver's reception of the at least one re-radiated harmonic signal of the transmitted signal produced by the transmitter.

4. The device of claim 3 wherein the diplexer further comprises a low pass filter for preventing any harmonic signal generated in the transmitter from interfering with the receiver receiving the at least one re-radiated harmonic signal and a high pass filter that prevents the transmitted signal from entering the receiver.

5. The device of claim 2 further comprising a retractable antenna extension assembly for supporting the single antenna and housing the electrically conductive cable that electrically connects the receiver and the transmitter to the single antenna.

6. The device of claim 5 further comprising a cable winder for automatically removing any slack produced in the electrically conductive cable when the retractable antenna extension assembly is retracted and providing additional electrically conductive cable when the retractable antenna extension assembly is extended.

7. The device of claim 1 further comprising a display for displaying the results of at least one measurement or calculation representing either the transmit signal's amplitude or the amplitude of the at least one re-radiated harmonic signal.

8. An apparatus for detecting the presence of a non-linear junction, the apparatus comprising:

a case housing electronic circuitry implementing the non-linear junction detector;

a transmitter for producing a transmit signal having a frequency and an amplitude, and radiating electromagnetic waves corresponding to the transmit signal;

a receiver for receiving re-radiated electromagnetic waves that were re-radiated by a non-linear junction in response to the radiated electromagnetic waves and producing a re-radiated harmonic signal;

a single circularly polarized antenna;

a cable connected at one end to said antenna and connected at the other end to at least one of said transmitter and receiver;

a cable winder for storing said cable, for rotating in one direction to wind said cable onto said winder for storage, and for rotating in the other direction for winding said cable off of said winder for use in extending the distance between said antenna and at least one of said receiver and transmitter.

9. The apparatus of claim 8 further comprising a retractable antenna extension assembly mechanically disposed between the antenna and the housing for extending and retracting the antenna relative to the case.

10. The apparatus of claim 9 further comprising a connection joint for rotatably connecting the case to the retractable antenna extension assembly.

11. The apparatus of claim 9 further comprising a microprocessor and display for receiving signals from the receiver and providing visual signals corresponding to the re-radiated harmonic signals and indicating when a non-linear junction has been detected.

12. The apparatus of claim 8 wherein said cable winder is attached to said antenna.

13. An apparatus for detecting the presence of a covert surveillance device having a non-linear junction, the apparatus comprising:

a transmitter for producing and transmitting a transmit signal having an amplitude;

a receiver for receiving and conditioning harmonic signals that were re-radiated by a non-linear junction in response to the transmitted signal to produce conditioned harmonic signals;

a microprocessor control circuit for receiving the conditioned harmonic signals from the receiver and producing audio signals representing amplitudes of the harmonic signals; and a speaker for receiving the audio signals from the microprocessor control circuit and producing audible sounds corresponding to the audio signals, whereby an operator may listen to the audible sounds and distinguish between different types of non-linear junctions based on the differences in the audible sounds.

14. The device of claim 13 further comprising an infrared transmitter for transmitting the audio signals representing the amplitudes of the harmonic signals to a pair of wireless infrared headphones wherein the pair of wireless infrared headphones receive and broadcast the audio signals.

15. The apparatus of claim 13 further comprising a display that receives signals from the microprocessor concerning properties of the harmonic signals and creates visual displays that indicate the presence of a non-linear junction to an operator of the apparatus.

16. The apparatus of claim 13 wherein the audio signals are demodulated versions of the received harmonic signals.

17. A device for detecting the presence of non-linear junctions, the device comprising:

a transmitter for producing a transmit signal having an amplitude;

a circular polarization antenna electrically connected to the transmitter for circularly polarizing and transmitting the transmit signal and for receiving circularly polarized harmonics of the transmit signal that are re-radiated by a non-linear junction in response to the transmit signal; and a receiver for receiving the circularly polarized harmonics of the transmit signal from the circularly polarized antenna and determining if a non-linear junction has been detected.

18. The device of claim 17 further comprising said circular polarization antenna being configured to transmit and receive signals of the same polarization.

19. The device of claim 17 further comprising a display for displaying an alpha-numeric message, a transmit power reading, a second harmonic power reading, or a third harmonic power reading.

20. The device of claim 17 further comprising a retractable antenna extension assembly for supporting the circular polarization antenna and an electrically conductive cable that electrically connects the receiver and the transmitter to the circular polarization antenna.

21. An electronic device for detecting the presence of non-linear junctions, the electronic device comprising:

a transmitter for producing a transmit signal having an amplitude;

a single circularly polarized antenna that is electrically connected to the transmitter so that the antenna receives the transmit signal from the transmitter and produces electromagnetic waves that radiate outward from the antenna and wherein the antenna produces at least one re-radiated harmonic signal in response to electromagnetic waves that have been re-radiated by a non-linear junction in response to the electromagnetic waves produced by the antenna;

a receiver that is electrically connected to the antenna so that the receiver receives the at least one re-radiated harmonic signal from the antenna and produces a conditioned harmonic signal;

a microprocessor that is electrically connected to the receiver for receiving the conditioned harmonic signal, examining the amplitude of the conditioned harmonic signal and determining if a non-linear junction is present;

a cable connecting the transmitter and receiver to the antenna;

a retractable antenna extension assembly for supporting the antenna and the electrically conductive cable that electrically connects the receiver and the transmitter to the antenna; and a cable winder holding the cable for automatically removing any slack produced in the electrically conductive cable when the retractable antenna extension assembly is retracted and providing additional electrically conductive cable when the retractable antenna extension assembly is extended.

22. The apparatus of claim 21 wherein said antenna is a circular polarization antenna having a center axis and said winder is integrally built into the circular antenna so that said circular antenna rotates about its center axis as the cable is wound on or off the winder.

23. An apparatus for detecting the presence of covert surveillance devices containing non-linear semi-conductor junctions, the apparatus comprising:

a transmitter for producing a transmit signal having an amplitude;

a single broadband antenna for transmitting the transmit signal and for receiving a second harmonic signal and a third harmonic signal of the transmitted signal that have been re-radiated by a non-linear junction;

a receiver for receiving the second and third harmonic signals from the broadband antenna, producing signals corresponding to the amplitude of the second and third harmonics and producing demodulated versions of the second and third harmonic signals;

a display located on the antenna for displaying an alphanumeric message, a transmit power reading, a second harmonic signal power reading, and a third harmonic signal power reading;

an electrically conductive cable for electrically connecting the transmitter and the receiver to the broadband antenna and for providing power and control signals to the display;

a diplexer for separating the transmit signal from the receiver, the diplexer comprising a low pass filter for preventing any harmonics generated by the transmitter from interfering with the received harmonic signals and a high pass filter for preventing the transmitted signal from entering the receiver;

a retractable antenna extension assembly for supporting the broadband antenna and housing the single electrically conductive cable that electrically connects the receiver and the transmitter to the broadband antenna;

an antenna connection joint attached to the retractable antenna extension assembly and the broadband antenna in a manner that provides two axis of rotation for the broadband antenna;

a keypad for providing user control of the non-linear junction detector;

a microprocessor control circuit for receiving signals from the keypad, sending signals to the display, receiving signals corresponding to the amplitudes of the second and third harmonic signals from the receiver, receiving demodulated versions of the second and third harmonic signals from the receiver, producing encoded audio signals representing demodulated versions of the second and third harmonic signals and producing encoded audio signals representing the amplitude of the second and third harmonic signals;

a cable winder for automatically removing any slack produced in the electrically conductive cable when the retractable antenna extension assembly is retracted and providing additional electrically conductive cable when the retractable antenna extension assembly is extended;

a transceiver case for mounting the retractable antenna extension assembly and containing the transmitter, receiver and microprocessor control circuit;

a connection joint for rotatably connecting the transceiver case to the retractable antenna extension assembly;

a slip ring assembly for electrically connecting the conductive cable to the display;

an audio circuit for receiving encoded audio signals representing demodulated versions of the second and third harmonic signals and producing sounds corresponding to the demodulated versions of the second and third harmonic signals; and an infrared transmitter for receiving the encoded audio signals representing the amplitude of the second and third harmonics from the microprocessor control circuit and transmitting the signals to a pair of wireless infrared headphones.

* * * * *

UNITED STATES PATENT AND TRADEMARK OFFICE

CERTIFICATE OF CORRECTION

PATENT NO. : 6,057,765
DATED : May 2, 2000
INVENTOR(S) : Thomas H. Jones and Bruce R. Barsumian It is certified that error appears in the above-identified patent and that said Letters Patent is hereby corrected as shown below:

Column 3, line 35, after "mounted", delete ")n" and insert –on–.

Column 6, line 50, after "electronic" delete "Inputs" and insert –inputs–.

Column 7, line 23, after "consists" delete "o)f" and insert –of–.

Column 9, line 9, after "detector 12" delete "flay" and insert –may–.

Column 10, line 9, after "transmitter 52." delete "Alter" and insert –After–.

Column 14, line 16, after "single" delete "circular" and insert –circularly–.

Signed and Sealed this

Tenth Day of April, 2001

*Attest:*

Nicholas P. Godici

NICHOLAS P. GODICI

*Attesting Officer*

*Acting Director of the United States Patent and Trademark Office*